US009041606B2

(12) United States Patent
Faraone et al.

(10) Patent No.: US 9,041,606 B2
(45) Date of Patent: May 26, 2015

(54) UNINTERRUPTED BEZEL ANTENNA

(75) Inventors: Antonio Faraone, Fort Lauderdale, FL (US); Giorgi G. Bit-Babik, Sunrise, FL (US)

(73) Assignee: Motorola Solutions, Inc., Schaumburg, IL (US)

( * ) Notice: Subject to any disclaimer, the term of this patent is extended or adjusted under 35 U.S.C. 154(b) by 217 days.

(21) Appl. No.: 13/308,100

(22) Filed: Nov. 30, 2011

(65) Prior Publication Data

US 2013/0135158 A1 May 30, 2013

(51) Int. Cl.
*H01Q 1/24* (2006.01)
*H01Q 13/10* (2006.01)
*H01Q 7/00* (2006.01)

(52) U.S. Cl.
CPC ..... *H01Q 13/10* (2013.01); *H01Q 1/243* (2013.01)

(58) Field of Classification Search
CPC ..... H01Q 5/00; H01Q 1/243; H01Q 9/0421
USPC ..... 343/702, 743, 746, 767
See application file for complete search history.

(56) References Cited

U.S. PATENT DOCUMENTS

| | | | | |
|---|---|---|---|---|
| 7,391,378 | B2 * | 6/2008 | Mikkola et al. | 343/702 |
| 7,551,142 | B1 | 6/2009 | Zhang et al. | |
| 7,612,725 | B2 | 11/2009 | Hill et al. | |
| 7,768,462 | B2 | 8/2010 | Zhang et al. | |
| 2004/0257283 | A1 * | 12/2004 | Asano et al. | 343/702 |
| 2008/0074329 | A1 * | 3/2008 | Caballero et al. | 343/702 |
| 2008/0316115 | A1 * | 12/2008 | Hill et al. | 343/702 |
| 2009/0153423 | A1 * | 6/2009 | Dinallo et al. | 343/767 |
| 2010/0123632 | A1 | 5/2010 | Hill et al. | |
| 2010/0123633 | A1 * | 5/2010 | Ozden et al. | 343/702 |
| 2010/0156728 | A1 * | 6/2010 | Alvey et al. | 343/702 |
| 2010/0238079 | A1 | 9/2010 | Ayatollahi et al. | |
| 2011/0001673 | A1 | 1/2011 | You et al. | |
| 2011/0006953 | A1 * | 1/2011 | Chiang et al. | 343/702 |

FOREIGN PATENT DOCUMENTS

EP 2081257 A1 7/2009

OTHER PUBLICATIONS

Di Nallo et al. ("Multiband internal antenna for mobile phones" Electronic Letters Apr. 28, 2005, vol. 41 No. 9).*
International Search Report and Written Opinion for International Patent Application No. PCT/US2012/60994 mailed Feb. 6, 2013.

* cited by examiner

*Primary Examiner* — Dameon E Levi
*Assistant Examiner* — Ricardo Magallanes
(74) *Attorney, Agent, or Firm* — Barbara R. Doutre

(57) ABSTRACT

A bezel forms a continuous, uninterrupted outer perimeter around the outside of a handheld radio device. The bezel is made of an electrically conductive material and is used as an antenna element. The bezel can be operated in either a common excitation mode or a differential excitation mode, depending on whether a user is presently holding the device, and making contact with the bezel.

25 Claims, 7 Drawing Sheets

UNINTERRUPTED BEZEL ANTENNA

FIELD OF THE DISCLOSURE

The present disclosure relates generally to antennas for handheld radio devices, and more particularly to an antenna formed in an uninterrupted bezel that forms a perimeter around the device.

BACKGROUND

Handheld radio devices such as cellular (or mobile) phones, including so-called "smart" phones, have become commonplace and are used by large segments of the population in developed regions of the world. The preferred shape and form factors of these devices have changed over the years. Various form factors and features, both aesthetic and functional, have been tried with varying degrees of acceptance among consumers. One aspect of handheld radio device design that has become a convention is the lack of an obvious antenna. Early devices used large, screw-in antennas similar to those used on public safety two-way radios. Retractable antennas then became common. Presently, very few cellular phones have a noticeable antenna. Some devices use an entirely internal antenna, while others have used external elements that are styled to provide an aesthetic feature of the device in addition to operating as an antenna. Among design challenges associated with all of these antenna designs is the loading effect of the human body, and in particular how the user of the device holds and positions the device when talking. Depending on the design and how a user holds the device, and in particular where the user's skin makes contact with the device, the radiated efficiency of the antenna can change significantly, and in some cases this can be a factor in unintentional call disconnection.

Some manufacturers use an external antenna configuration where an externally protruding element of the device contains one or more antenna structures. In one particular handheld radio device presently available in the market the handheld radio device uses a metal bezel that appears to wrap around the sides of the device to form two separate antennas, operating in distinct frequency bands, realized in part by interrupting the bezel continuity with small gaps. However, this aesthetically appealing design suffered significant performance issues caused by user's hands making contact with the bezel antenna elements. As a result, the radio frequency performance was degraded to the point that radio connections were lost at an unexpectedly high rate, resulting in what is commonly referred to as "dropped calls." Dropped calls result from the communication being terminated as a result of the radiated efficiency dropping so low that the cellular base station does not receive either sufficiently strong signal from the device, or because of unacceptably low data throughputs.

Accordingly, there is a need for an antenna design that hides the antenna while providing similar or better device aesthetics (for instance by making it possible to have an uninterrupted metal bezel), but is less prone to severe degradations in performance depending on how the user holds the device.

BRIEF DESCRIPTION OF THE FIGURES

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
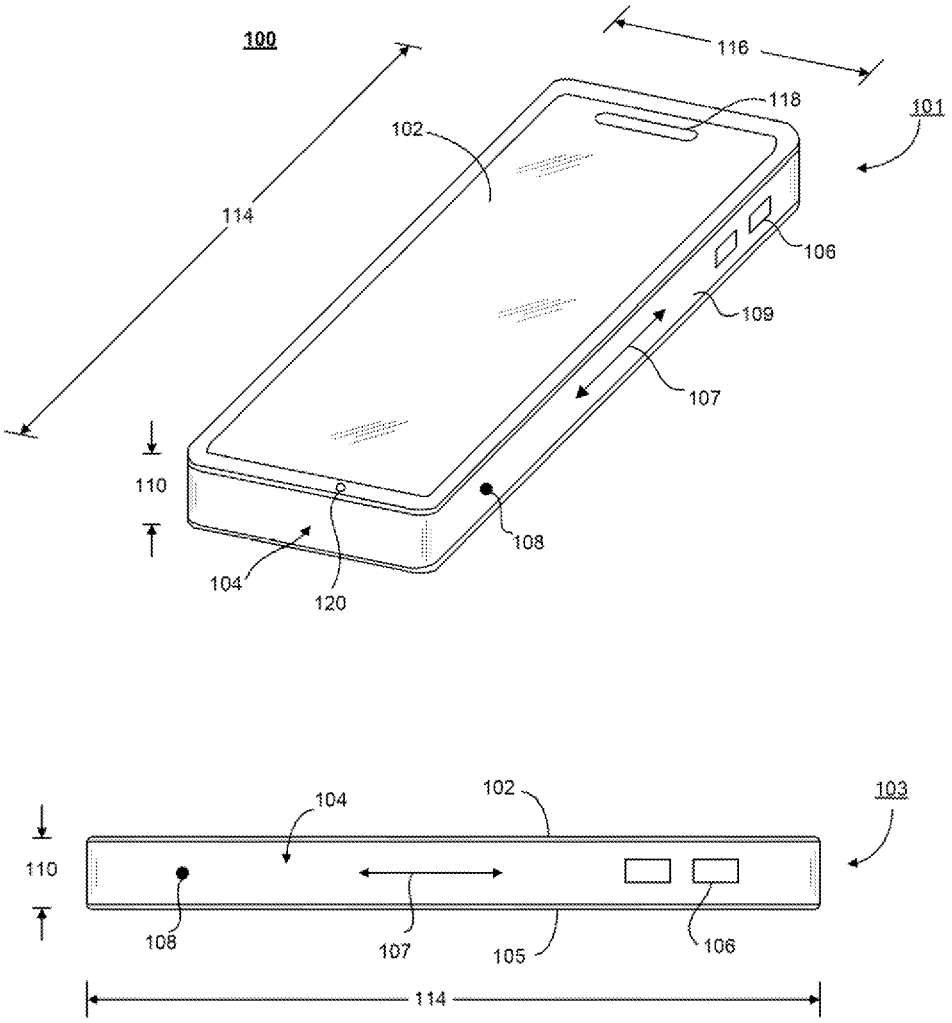
FIG. 1 shows an isometric view and a side elevational view of a handheld radio device in accordance with some embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

Embodiments include an antenna and a device using an antenna that is comprised of an uninterrupted metal bezel that forms an outer perimeter of a handheld device. A planar electrically conductive mass is disposed within the handheld device that forms a contiguous slot between the mass and the uninterrupted bezel around at least a portion of the device. A feed element is disposed within the handheld device that is electromagnetically coupled to the uninterrupted bezel to drive the uninterrupted bezel at radio frequencies. A feed point along the feed element connects the feed element to a radio frequency circuit 222 of the handheld device that is coupled to the feed element at a point relative to the uninterrupted bezel.

FIG. 1 shows an isometric view 101 and a side elevational view 103 of a handheld radio device 100 in accordance with some embodiments. The views 101, 103 shown here represent what is presently one of the more popular form factors for a cellular telephone. Generally, the device shown is monolithic, substantially rectangular, and has a graphical display that occupies most of the front major surface 102. In embodiments where the device 100 is generally rectangular, the device 100, and therefore the bezel 104, can have rounded corners. The device 100 has a length 114, width 116, and height 110. The height 110 is the distance between the front 102 and back 105 surfaces, and may alternatively be referred to as the thickness of the device 100. In some of the rectangular embodiments, the device 100 can have approximate dimensions of a height 110 of nine millimeters, a length 114 of one hundred fifteen millimeters, and a width 116 of sixty millimeters.

The bezel 104 is disposed around the sides of the device to form a continuous perimeter around the device 100, and is a continuous metallic or otherwise electrically conductive member. The bezel 104 generally forms a rim or other outer structure around the outside of the device 100. The bezel 104 therefore has an outer surface 109. The bezel 104 has a height measured in the same dimension as device height 110 such that the outer surface 109 covers a substantial proportion of the height 110 and can have a substantial "ribbon" shape. In some embodiments the bezel 104 has a height of at least half the height 110 of the device 100. In some embodiments the device 100 can have multiple body sections, such as in a folding or sliding configuration. In such embodiments the bezel 104 can form an outer perimeter of one or both of the body sections. The device 100 and bezel 104 also do not have to be rectangular, but the physical dimensions of the bezel 104 should lend themselves to radio frequency operation in the frequency bands used by the device 100. Regardless of the configuration of the device 100, the bezel 104, by forming an outer perimeter of the device 100, also acts as part of the external housing of the device 100 in some embodiments. That is, the bezel 104 can form an outermost perimeter of the device 100.

As used here the term "uninterrupted" means that there is no electrical interruption between any two points on the bezel 104, in a path around the bezel 104 in either of the directions of arrow 107, meaning the bezel 104 is continuous around the perimeter of the device. Furthermore, in a path around the bezel 104 in the directions of arrow 107, in some embodiments, there are no stricture points (narrowing) or other significant variations in the height of the bezel 104 that introduce a significant inductance to radio frequency currents. In other embodiments one or more stricture points may be used to tune the RF characteristics of the bezel 104 antenna, but in all embodiments there is a direct current (DC) continuity around the bezel 104. There are no gaps or other breaks in electric current continuity in the bezel 104. The bezel 104 can have opening for features such as buttons 106 or connectors 108, such as an audio jack, a universal serial bus (USB) connector, or other types of connectors. The device 100 can further include an ear port 118 for transmitting acoustic signals from a speaker to be heard by a user, and a microphone port 120 for receiving acoustic signals from a user, as is known.

Figure 2:
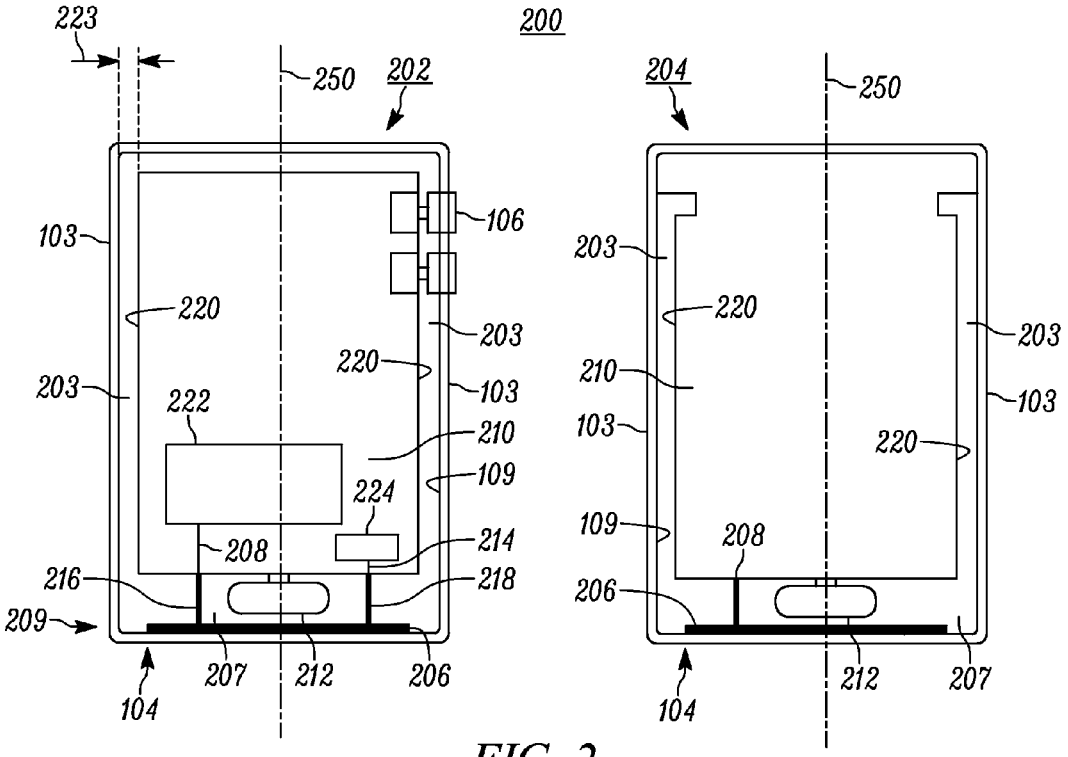
FIG. 2 shows first and second alternative arrangements of an uninterrupted bezel antenna implementation in accordance with some embodiments.

FIG. 2 shows first 202 and second 204 alternative arrangements of an uninterrupted bezel antenna implementation 200 in accordance with some embodiments. Specifically the present views show the bezel 104 without the housing or other external components of the device that are typically present, but with the internal mass 210 of the device. The internal mass 210 specifically refers to electrically conductive components housed inside the device, including circuit board metallization, RF shields, battery cells, and so on. These metalized components can be grounded. Typically a battery cell container is the negative terminal of the cell, and provides a good ground reference in conjunction with the circuit board ground layers and any grounded metallic frame components or stiffeners used to ruggedize the device. RF shields are also typically grounded to prevent circuits and components underneath from coupling to, or radiating RF electromagnetic radiation. Typically the circuit board underneath shielded components will include a ground plane to further protect the components, with signals going in and out of the shielded circuit on suitably protected lines using, for example, RF filter chokes and capacitors. The result is that the internal mass 210 of the device includes a substantial planar area of grounded metallization having not only length and width, but also significant height due to the height of components such as shields, battery cell containers, and the thickness of the circuit boards. The bezel 104, forming the outer perimeter of the device, surrounds the internal mass 210, which is disposed within the device. An inner surface 109 of the bezel 104 faces inwards towards the internal mass 210. An outer lateral surface 220 of the internal mass 210 faces the inner bezel surface 109. In some embodiments the lateral surface 220 can be a composite of select lateral surfaces of grounded metal elements of the internal mass 210, or can comprise a grounded metallic part, for instance a portion of the device frame, suitably shaped to yield the desired electromagnetic coupling with the device bezel by realizing the appropriate amount of capacitance between surfaces 109 and 220. Buttons 106 can include actuator elements that protrude through the bezel 104 in openings formed in the bezel 104. The actuator elements of buttons 106 are non-metallic so as to not couple RF signals from the bezel 104 into the circuitry of the device through the button circuit. In some embodiments actuator elements of buttons 106 can include some functional or cosmetic metal part so long as any electromagnetic coupling, and variations thereof due to different mechanical states, (e.g., up or down positions) of buttons 106, that could be introduced between the bezel 104 and the internal mass 210 is taken into account in the design of the antenna. In arrangement 202 the internal mass 210 is not DC-connected to the bezel 104, and in arrangement 204 the internal mass 210 is DC-connected to the bezel 104. In both arrangements, a slot 203 is formed between the bezel 104 and the mass 210, resulting in a slot antenna form. The slot 203 features a slot width 223, between the lateral surface 220 of internal mass 210 and the inner surface 109 of the bezel 104, which in some embodiments varies along a path following the slot 203 in order to realize a desired antenna frequency response. The height of the lateral surface 220 of mass 210 and the height of the bezel 104 provide for a "deep" slot compared to, for example, planar slot antennas, thereby resulting in much higher capacitance per unit length for the slot 203. The slot in arrangement 202 completely circumscribes the internal mass 210, while the slot in arrangement 204 is substantially "U" shaped. The particular shape and width of the slot can be changed, resulting in varying RF performance based on the specific shape, length, width, and height dimensions, for different applications. Generally the total slot length can be selected based on the frequency or frequencies at which the device is operated, and the slot width 223 can be selected for a desired bandwidth of operation.

A feed element 206 can be capacitively coupled to the bezel 104 and used to drive the bezel antenna. The feed element 206 comprises a feed leg 216 that protrudes towards the internal mass 210 which include device radio frequency components 222 such as a RF power amplifier. The feed leg 216 can be coupled at a feed point 208 to a feed from, for example, an RF power amplifier on a circuit board of the device, which form a part of the mass 210. Similarly, the feed point 208 can likewise be coupled to a receiver circuit of the device as well. The feed element 206, including feed leg 216, can be shaped arbitrarily and can be realized using different techniques, for instance using flexible circuit board. The feed element 206 can be mounted on the bezel 104 using, for example, an adhesive member such as a double sided tape that is an electrical insulator. The feed element 206 can be symmetrical with respect to the device centerline 250, or it can be asymmetrical, i.e. off center. The feed element 206 can be fed off-center, meaning the feed point 208 is not symmetrical with respect to the feed element 206. As a result, a portion of the feed element 206 to one side of the feed point 208 can be larger than the portion of the feed element 206 on the other side of the feed point 208. The placement of the feed point 208 on the shape of feed element 206, including feed leg 216, can be selected to achieve the desired impedance behavior of the slot antenna at the various operating frequency bands of the device. In some embodiments there can be more than one feed point, such as a second feed point 214, and a corresponding second feed leg 218. The second feed point 214 can be used to provide access to a second radio frequency transceiver. The second feed point 214 can also be connected to the same radio frequency transceiver that is connected to the first feed point 208, for instance to realize a distributed antenna feed architecture. Alternatively, the second feed point 214 can be loaded with an electric circuit 224 comprising passive components, for instance to provide an improved impedance match at the first feed point 208.

The slot 203 can form a cavity or chamber 207 that can accommodate a speaker 212. Thus, the chamber 207 and the slot 203 generally can form an acoustic reservoir inside the device to provide a substantial volume of air which can be beneficial for high audio speaker operation, such as for speakerphone operation. As shown here the speaker 212 is disposed in the slot chamber 207 at one end 209 of the device, which can be considered to be the bottom of the device when the device is held upright. The speaker 212 and chamber 207 can be located elsewhere in the device in some embodiments.

Figure 3:
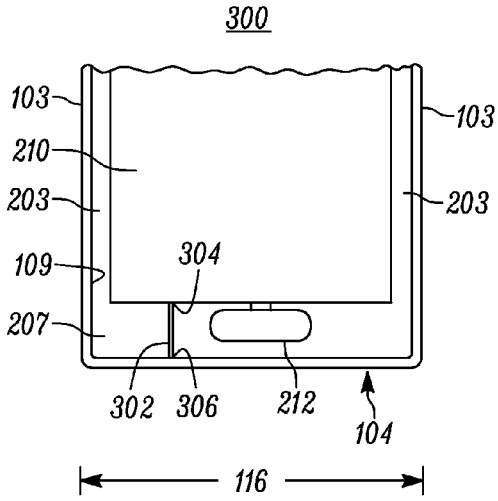
FIG. 3 shows a direct feed arrangement for an uninterrupted bezel antenna in accordance with some embodiments.

FIG. 3 shows a direct feed arrangement 300 for an uninterrupted bezel antenna in accordance with some embodiments. Rather than using a capacitively coupled feed element 206 as in FIG. 2, the RF circuitry of the device can be directly coupled to the bezel 104 using a conductive direct feed element 302. As with the feed arrangement in FIG. 2, the direct feed element 302 can be connected to a feed point 304 on the internal mass 210 and an excitation point 306 on the bezel 104. In some embodiments, as shown in the FIG. 3, the feed point 304 is off-center of the width 116 dimension of the bezel 104. In some embodiments the off-center feed point 304 and excitation point 306 can be located along the length 114 of the bezel 104. In other embodiments there can be more than one direct feed point. And in still other embodiments the bezel 104 can be driven using a combination of capacitively coupled and directly coupled feed elements.

Figure 4:
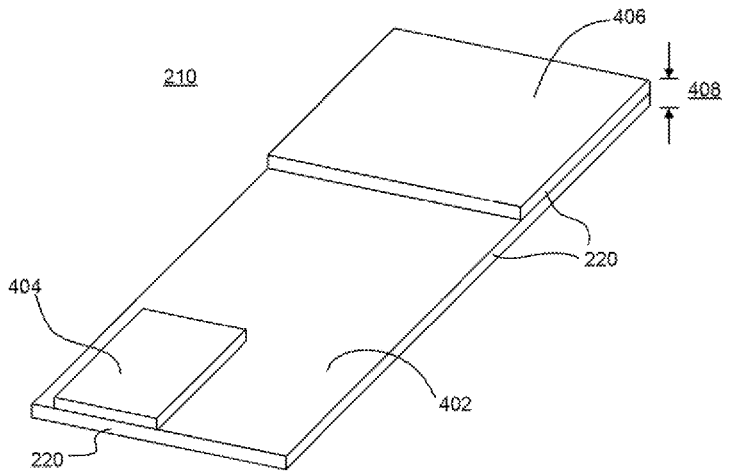
FIG. 4 shows an isometric view of an internal component arrangement for a handheld device in accordance with some embodiments.

FIG. 4 shows an isometric view of an internal component arrangement 400 for a handheld device in accordance with some embodiments. The arrangement 400 shows various components of the internal mass 210 of the device. The components can include a circuit board 402, a shield 404, and a battery 406. The circuit board can contain one or more ground planes of metallization. The shield 404 is one example of a metal structure that is used to cover circuits that are either producing RF signals, or are sensitive to RF signals. As is well known, the shield can be formed as a bottomless box type of structure that is placed over the circuit components being shielded. Thus, the shield has a significant height. The shield 404 is typically electrically grounded. The battery 406 can include one or more battery cells, where each battery call is packaged in a metal can structure with the outside of the can being the electrically negative terminal of the battery cell. Many hand held devices being designed and manufactured today use a single lithium ion battery cell. The negative terminal of the cell is used as the ground reference for all circuitry in the device. Thus, the outside of the battery 406, which also has a significant thickness, contributes to the internal mass 210 that defines the slot 203 between the lateral surface 220 of the internal mass 210 and the internal surface 109 of the external bezel 104, as shown in FIG. 2. The mass 210 therefore has a significant height 408 at one or more sides of the mass 210, which can allow for improved coupling between its lateral surface 220 and the bezel 104. Specifically, the lateral surface 220 faces the inner surface 109 of the bezel 104, forming an interface region along at least a portion of the slot 203 between the lateral surface 220 and the inner surface 109 of the bezel. In some embodiments the interface region can be co-extensive with the slot length, and in some embodiments the interface region can be less than the slot length.

FIGS. 5-6, and 8-9 show various graphs of the return loss in decibels over frequency of particular embodiments of an uninterrupted bezel antenna in accordance with some embodiments. The reported return loss is the magnitude of the antenna reflection coefficient, in decibels. The particular physical parameters of the bezel and internal mass can be varied to achieve differing results. Each of the graphs are meant to show general performance of an uninterrupted bezel antenna in different operating environments.

Figure 5:
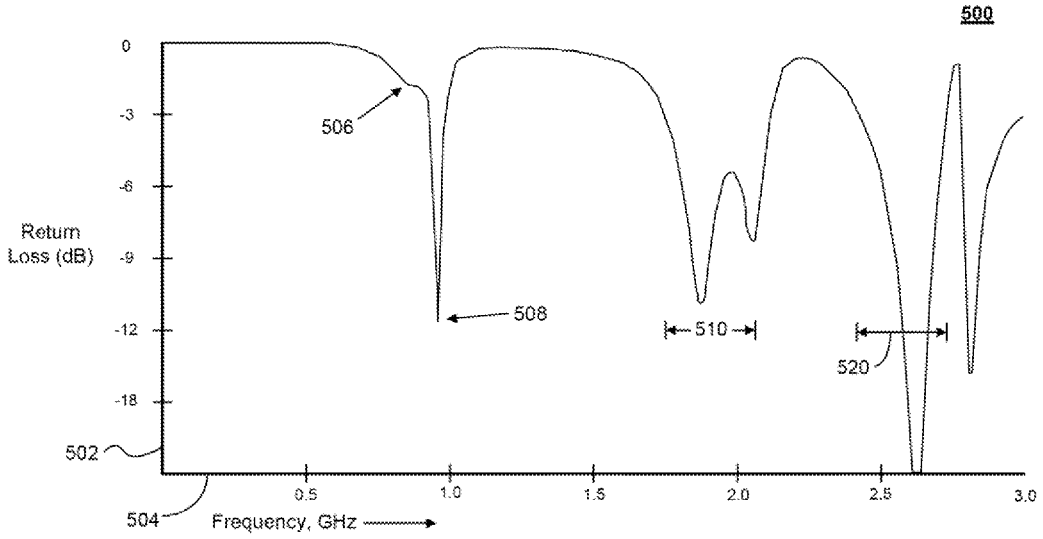
FIG. 5 shows a graph chart of return loss performance for an uninterrupted bezel antenna designed in accordance with some embodiments.

FIG. 5 shows a graph chart 500 of return loss performance for an uninterrupted bezel antenna operated in free space and designed in accordance with some embodiments. Free space means there is no electromagnetically significant body in proximity to the device, and in particular it means that a user is not holding the device. In embodiments where the bezel 104 is used by a mobile communication device, such as a cellular telephone, there are several frequency bands of interest over which the device may communicate using RF signals. Generally these are referred to in the art as the 850 megahertz (MHz), 950 MHz, and 1700-2100 MHz bands. In some embodiments the device may communicate using the 2400-2700 MHz band as well for certain type of data communications such as WiMAX and LTE wireless networks as well as wireless local area networks and personal area networks such as, for example, those generally in accordance with the Institute of Electrical and Electronic Engineers (IEEE) in the 802.11x specification sections and commonly referred to as "Wi-Fi".

As is known, antennas that exhibit some level of geometrical symmetry can be driven, or excited, in order to support a differential electromagnetic mode and a common electromagnetic mode. Relative to a symmetry plane containing centerline 250 in the bi-dimensional projection plane of the antenna arrangements in FIG. 2, such a symmetry plane being orthogonal to the projection plane, a common mode exhibits substantially symmetrical electrical charge distribution, whereas a differential mode exhibits substantially anti-symmetrical charge distribution. Likewise, the corresponding current density vectors exhibit a substantial mirror-like symmetry with respect to said symmetry plane for a common mode, whereas for a differential mode the mirrored vectors exhibit opposite phase. In general, an asymmetric feed structure is capable of exciting both common and differential electromagnetic modes in a substantially symmetrical antenna structure. Accordingly, the present uninterrupted bezel antenna can likewise be excited in a differential mode and a common mode, which have different impedance characteristics. In the present example, testing a device substantially similar to that of arrangement 204 in FIG. 2, where the mass 210 is DC-coupled to the bezel 104, the frequency response for return loss can be substantially similar to that shown in FIG. 5, where the vertical axis 502 is the magnitude of the antenna reflection coefficient, or return loss, in decibels, and the horizontal axis 504 is frequency from 0-3 GHz. Testing in free space indicates that the differential mode, whose frequency response is best at excursion 508 in the 950 MHz band, is preferable. However, common mode provides a better response in the 850 MHz band, at point 506. As used here, the term "freespace" refers to the condition where a user is not holding or otherwise making contact with the device, thus the device's antenna is "free" of loading or mismatch that normally results from contact with a human body. The response at point 506, although not as good as that at excursion 508, is acceptable for most cellular networks particularly since, by definition, there is no energy loss associated to the user's body proximity when the device is in free space. The high band (1700-2100 MHz) has a substantial wideband response 510, while another wideband response 520 is available in the 2400-2700 MHz band.

Figure 6:
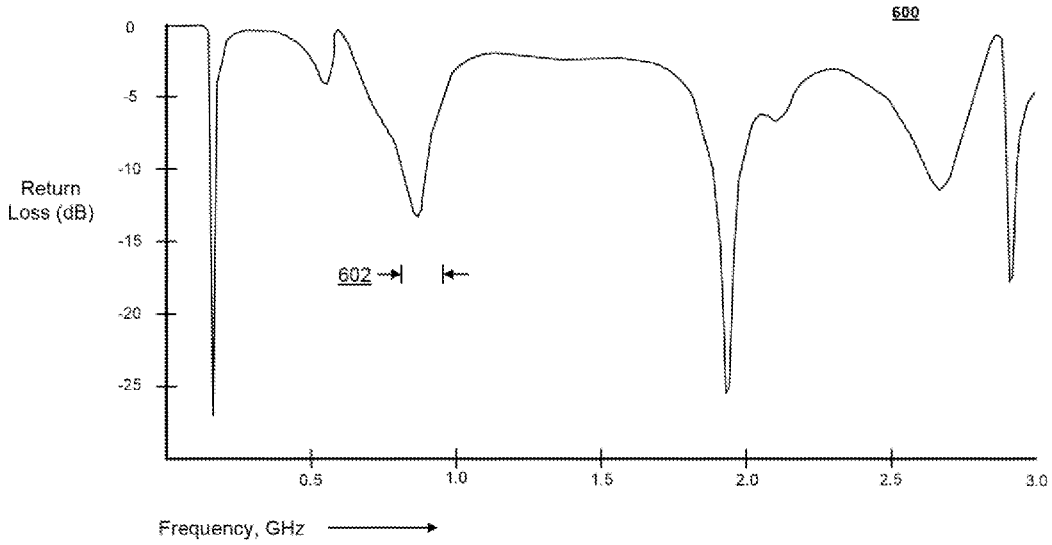
FIG. 6 shows a graph chart of return loss performance for an uninterrupted bezel antenna operated in a simulated user's hand and designed in accordance with some embodiments.
Figure 7:
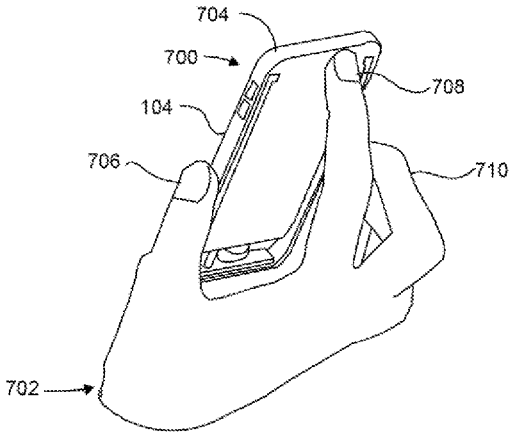
FIG. 7 shows a simulated user's hand holding a device using an uninterrupted bezel antenna in accordance with some embodiments.

FIG. 6 shows a graph chart 600 of return loss performance for the same uninterrupted bezel antenna whose free-space response was described in FIG. 5, where in this case the device is operated in a simulated user's hand. FIG. 7 shows a simulated user's hand 702 holding a device 700. The user's thumb 706 makes contact with the bezel 104 on a first side of the bezel, the user's index finger 708 makes contact with the back of the device 700 near the top 704 of the device 700, and the user's other fingers 710 make contact with a second side, opposite the first side. The posture depicted is a typical posture for holding a device such as device 700. The user's hand contact diverts portions of the radio frequency currents from inside the antenna lateral slots, such as slots 203 as shown in FIG. 2, to the outside, which improves significantly the impedance matching of the common mode at 850 MHz. Thus, when the device 700 is operated in a user's hand, a common mode of excitation is preferable because it features a much wider bandwidth than the differential mode. As can be seen in the graph chart 600, using a common mode while the user is holding the device as in FIG. 7, results indicate a favorable low band 602 performance while maintaining the favorable responses in the higher bands. Furthermore, the absence of gaps in the metal bezel eliminates the severe performance degradations observed in devices incorporating a segmented bezel antenna, when the user's finger is placed across the bezel gap.

Figure 8:
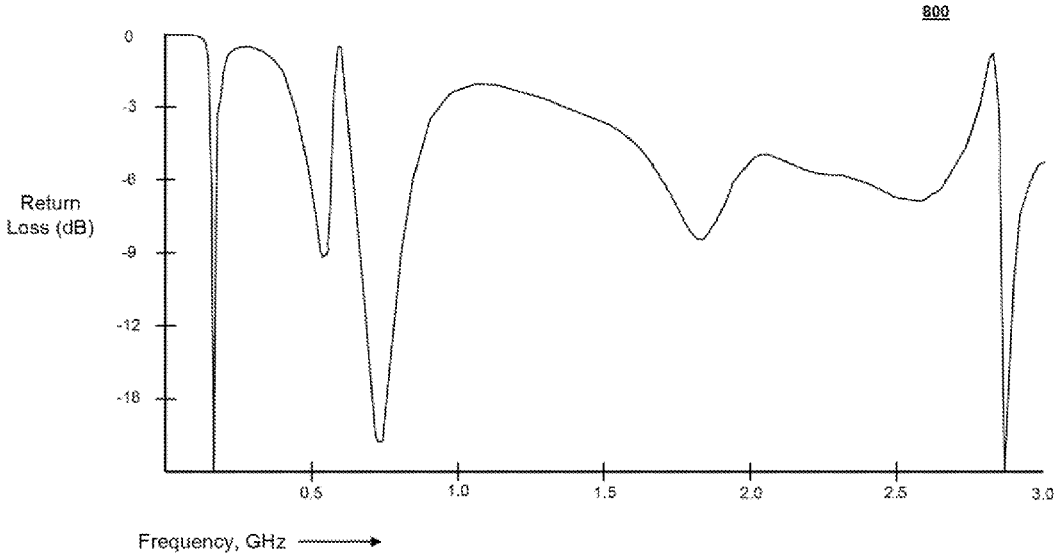
FIG. 8 shows a graph chart of return loss performance for an uninterrupted bezel antenna operated while held in a simulated user's hand and held to a user's head and designed in accordance with some embodiments.

FIG. 8 shows a graph chart 800 of return loss performance over frequency for the same uninterrupted bezel antenna considered in FIGS. 5 and 6 operated while held in a simulated user's hand and held to a user's head. The response when the device is used in this position shows a similar behavior to when the device 700 is held in a user's hand 702. Thus, common mode excitation is preferable in the lower bands, and acceptable performance is observed in the higher bands as well.

Figure 9:
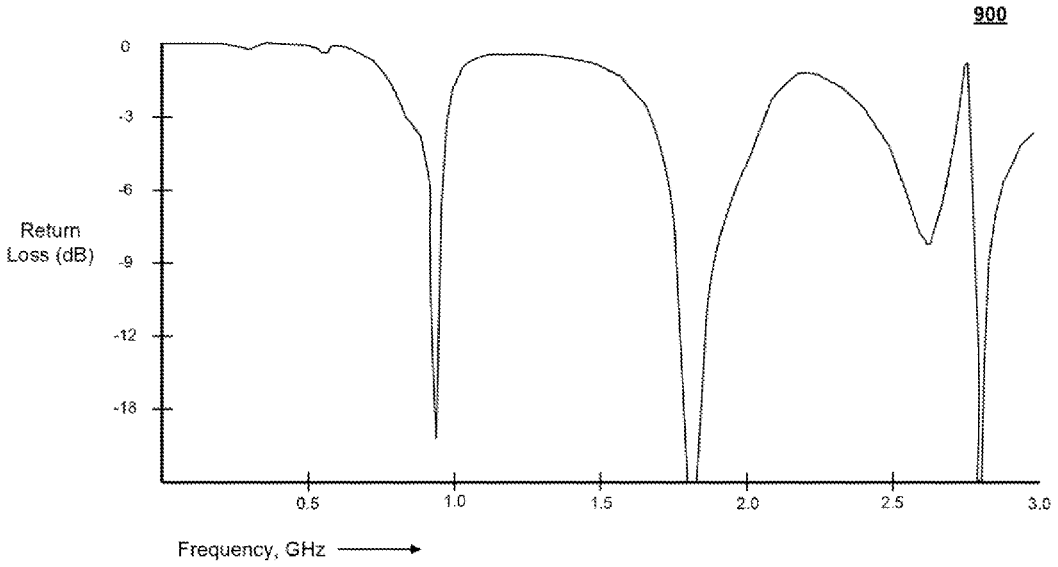
FIG. 9 shows a graph chart of return loss performance for an uninterrupted bezel antenna operated while the device is worn next to a user's body, and designed in accordance with some embodiments.

FIG. 9 shows a graph chart 900 of return loss performance over frequency for the same uninterrupted bezel antenna considered in FIGS. 5-7 operated while the device is worn next to a user's body. For example, the user can wear the device in a belt holster. In this scenario, the user is not actually holding or making direct contact with the device. The results indicate, as with the free space scenario of FIG. 5, that differential mode of excitation provides better performance. The antenna provides acceptable performance in both the low and high bands. In particular, embodiments allow antenna performance that achieves industry acceptable radiated performance in the conventional modes of use (freespace, held in hand, held next to head, worn on body) without suffering unacceptable degradation due to contact with the user's hand anywhere on the metal bezel.

In some embodiments, when multiple antenna feed points are driven by the radio frequency transceiver as in arrangement 202 of FIG. 2 featuring feed points 216 and 218 which can for instance be operated in phase or opposite phase in order to excite common or differential modes respectively, the device can detect whether the user is holding the device, or if the device is operating in free space, and change the mode of excitation, either common mode or differential mode, accordingly. There are numerous ways in which the device can determine whether it is being held by a user. For example, it is known to use proximity sensors to determine if the device is being held to a user's head. It is known to use a Hall effect sensor to determine if the device is in a holster (free space or worn on body). The device can determine the antenna mismatch and determine whether it should operate in a common mode or differential mode based on detected mismatch.

Figure 10:
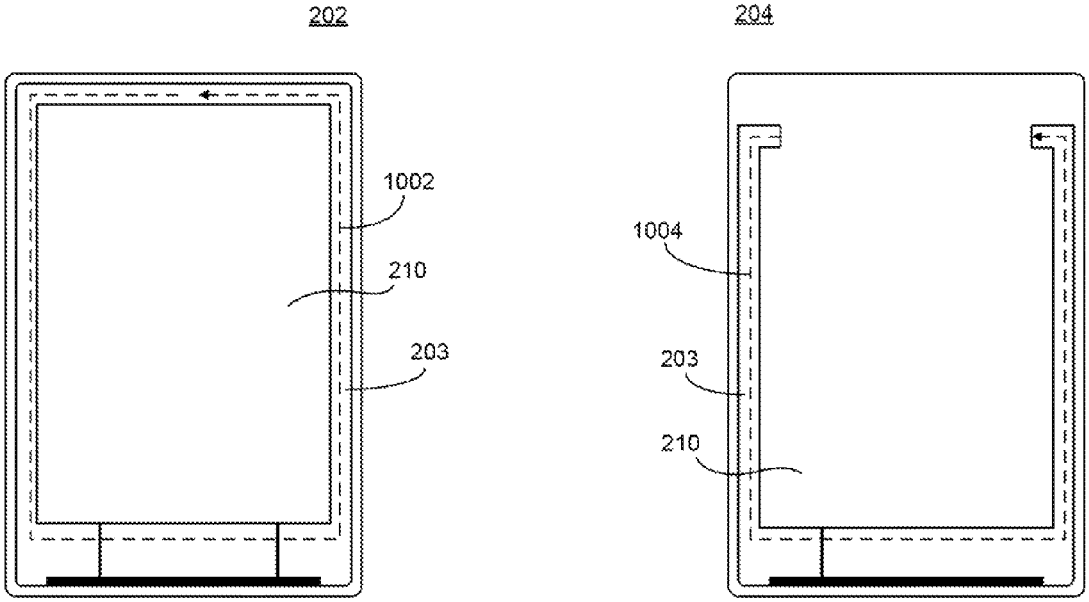
FIG. 10 shows slot length of the two different arrangements of FIG. 2 in accordance with some embodiments.

FIG. 10 shows the two different arrangements of FIG. 2, in particular arrangement 202 and arrangement 204. In each arrangement 202, 204, the slot 203 has a length. In arrangement 202 the slot length is along path 1002, which goes essentially completely around the internal mass 210. In arrangement 204, the slot length is along path 1004, which does not go completely around the internal mass 210, and approximates a U-shape. The slot length affects the performance of the bezel 104 antenna. In some embodiment the slot length can be configured to be one half of a wavelength of the lowest frequency of operation used by the device.

Figure 11:
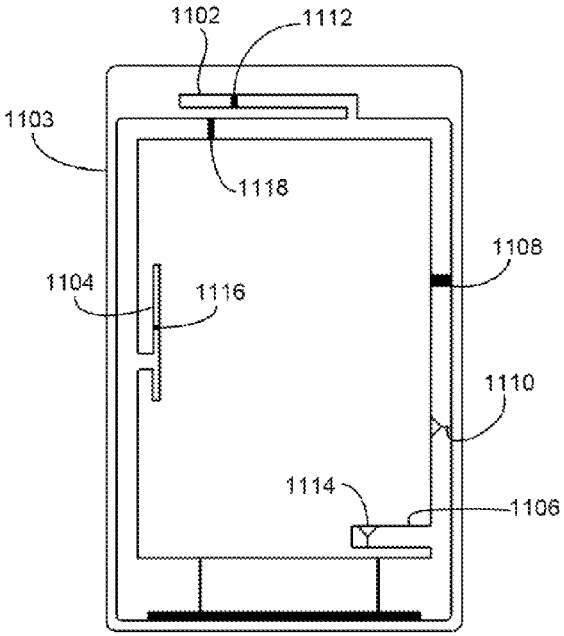
FIG. 11 shows several slot configurations and loadings for use with an uninterrupted bezel antenna in accordance with some embodiments.

FIG. 11 shows several slot and loading configurations for use with an uninterrupted bezel antenna in accordance with some embodiments. Generally a variety of slot arrangements will occur to those skilled in the art upon reading the present specification. For example, the bezel slot 1102 can be formed in the bezel 1103. The bezel slot 1102 can be used for other types of communication, at higher frequencies, for example, such as Global Positioning Satellite (GPS) signal reception. Slot 1102 can also be used to realize a series reactive load to slots 1002 or 1004 in arrangements 202 and 204, respectively, such a load being of capacitive or inductive nature depending on the length and shape of slot 1102. A slot 1104 or notch 1106 realized on internal mass 210, for instance on the circuit board, can likewise be used for other types of communication and to effect series reactive loading of slot 1002 or 1004. In some embodiments a loading impedance 1108 can be used to provide a capacitive or inductive shunt impedance loading of slot 1002 or 1004, for instance to match the bezel 1103 radio performance for a desired frequency band. Likewise, a shunt impedance loading 1112 could be realized in the loading slot 1102 to achieve a desired electrical behavior. In some embodiments a switched feed or load 1110 can be used to disconnect one or more of multiple feeds or loads to adjust operation of the bezel 1103 as an antenna. The switch employed to effect such operation adjustments can be a single or multiple pole switch, and in the latter case it can be connect to a multiplicity of loads and radio frequency transceivers. Likewise, a switched feed or load 1114 could be realized in the loading slot 1106 to achieve a desired electrical behavior in each of the states of the switch. In some embodiments, a radio frequency feed can be applied to one of the secondary slots, for instance feed 1116 can be applied to slot 1104. Therefore, in some embodiments multiple slots can be used in conjunction with the slot between the bezel 1103 and internal mass 210. The same signal can be fed to, for example, slot 1104 and the bezel 1103 to augment the radio performance of the device. In some embodiments, an additional radio frequency feed 1118 can be applied across slot 1002 or 1004. The device, in some embodiments can selectively connect or disconnect one or more of several feed points or feed elements via switches such as switched feed 1110, depending on external antenna loading as determine by the current use of the device (e.g., in the hand while browsing) as it can be detected through hardware sensors and software means, band of operation, and so on.

Figure 12:
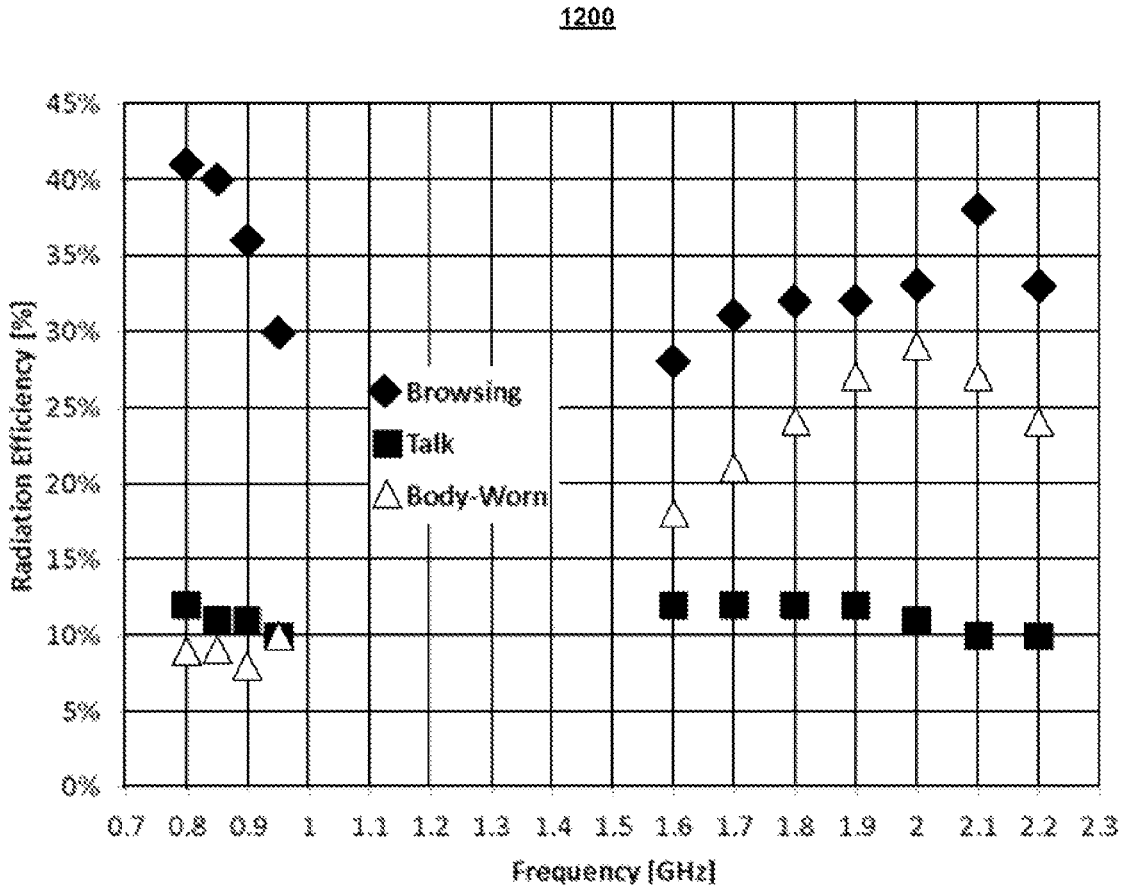
FIG. 12 shows a graph chart of radiated efficiency of an uninterrupted bezel antenna over frequency for several use modes, in accordance with some embodiments.

FIG. 12 shows a graph chart 1200 of radiated efficiency of an uninterrupted bezel antenna, in accordance with some embodiments, over frequency for several of the aforementioned use modes of a handheld radio device using an uninterrupted bezel antenna in accordance with some embodiments. The modes shown are consistent with those described in reference to FIGS. 6, 8, and 9. In particular the graph chart 1200 shows a browsing mode plot represented by diamonds, a talk mode plot represented by squares, and a body-worn plot represented by triangles. The browsing mode refers to the user holding the handheld radio device with the user's fingers making contact at several places on the uninterrupted bezel antenna, such as when using the device to browse information displayed by the handheld radio device, such as shown in FIG. 7. The talk mode refers to the user holding the device to the user's head, as when talking into or otherwise using the device for telephonic communication. In the talk mode the user is also holding the handheld radio device with the user's hand making contact at several places on the uninterrupted bezel antenna. The body-worn mode refers to the user wearing the handheld radio device, such as in a belt holster, at a space of about ten millimeters from the user's body. As can be seen in the graph chart the performance of the uninterrupted bezel antenna is not degraded by the user holding the device in the browsing mode, and in the talk mode the performance remains at an acceptable level throughout the frequency range.

Thus, the uninterrupted bezel antenna provides acceptable radio performance whether the user is holding the device using the uninterrupted bezel antenna or not. As a result, the device provides superior operation over other devices which use a segmented bezel antenna, for example. A benefit of the uninterrupted bezel antenna is that a device using the uninterrupted bezel antenna is less likely to experience dropped calls no matter how the user holds or wears the device.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. An antenna configuration for a handheld device, comprising:

an uninterrupted bezel forming an outer perimeter electrically conductive member of the handheld device;

a substantially planar electrically conductive mass disposed within the handheld device forming a contiguous slot between the planar electrically conductive mass and the uninterrupted bezel, wherein the uninterrupted bezel surrounds the planar electrically conductive mass disposed within the same plane as the uninterrupted bezel;

a slot formed in the uninterrupted bezel;

a notch realized on the substantially planar electrically conductive mass;

a feed element disposed within the contiguous slot, wherein the feed element is capacitively coupled to the uninterrupted bezel;

a feed point that connects the feed element to a radio frequency circuit of the handheld device, the feed point being coupled to the feed element at a point on the uninterrupted bezel which forms an asymmetrical feeding arrangement wherein the feed point is off-center relative to the feed element, a first portion of the feed element being located on one side of the feed point and a second portion of the feed element being located on another side of the feed point, the first portion being larger than the second portion, the asymmetrical feeding arrangement being driven to operate the antenna in a differential mode or driven to operate the antenna in a common mode in response to operating frequencies applied to the feed point and resulting establishment of an electrical charge distribution over the antenna configuration; and a loading impedance providing shunt loading of the slot formed in the uninterrupted bezel, wherein the shunt loading controls matching of the bezel to a predetermined radio frequency band.

2. The antenna configuration for the handheld device of claim 1, wherein the bezel has at least one aperture through which at least one button having a non-conductive actuator element protrudes.

3. The antenna configuration for the handheld device of claim 1, wherein the handheld device is a substantially rectangular device having a width and a length in a plane of a front surface, and a side height between the front surface and a back surface, the bezel has a height that is at least half of the side height of the handheld device.

4. The antenna configuration for the handheld device of claim 1, wherein the planar electrically conductive mass is electrically separate from the uninterrupted bezel.

5. The antenna configuration for the handheld device of claim 1, wherein the planar electrically conductive mass includes at least one of a ground plane of a shield, or a battery used to power the handheld device.

6. The antenna configuration for the handheld device of claim 1, wherein the planar electrically conductive mass is electrically coupled to the uninterrupted bezel.

7. The antenna configuration for the handheld device of claim 6, wherein the planar electrically conductive mass is electrically coupled to the uninterrupted bezel at at least a point opposite from the feed element in the handheld device.

8. The antenna configuration for the handheld device of claim 1, further comprising a second feed point.

9. A handheld radio device, comprising:

an uninterrupted bezel forming an outer perimeter electrically conductive member of the handheld radio device;

a substantially planar electrically conductive mass disposed within the handheld radio device forming a contiguous slot between the planar electrically conductive mass and the uninterrupted bezel, wherein the uninterrupted bezel surrounds the planar electrically conductive mass disposed within the same plane as the uninterrupted bezel; and a feed element disposed within the contiguous slot, wherein the feed element is capacitively coupled to the uninterrupted bezel;

a slot formed in the uninterrupted bezel;

a notch realized on the substantially planar electrically conductive mass;

a radio frequency feed comprising a feed point that connects the feed element to a radio frequency circuit of the handheld radio device, the feed point being coupled to the feed element at a point that is off-center relative to a length or width of the bezel to operate the bezel as an antenna of the handheld radio device, the radio frequency feed forming an asymmetrical feeding arrangement with the bezel to selectively excite the uninterrupted bezel in either a differential mode or a common mode; and a loading impedance providing shunt loading of the slot formed in the uninterrupted bezel, wherein the shunt loading of the slot controls matching of the bezel to a predetermined radio frequency band.

10. The handheld radio device of claim 9, further comprising a speaker disposed within the contiguous slot.

11. The handheld radio device of claim 9, further comprising at least one opening in the uninterrupted bezel and a button actuator disposed in the opening.

12. The handheld radio device of claim 9, wherein the contiguous slot has a length of half a wavelength of a lowest operating frequency of the handheld radio device.

13. The handheld radio device of claim 9, wherein the uninterrupted bezel has a height that is at least half a height of the handheld radio device.

14. The handheld radio device of claim 9, wherein the common mode is excited based on an external loading of the antenna when the handheld radio device is being held in a user's hand.

15. The handheld radio device of claim 9, further comprising a second feed element that is loaded with an electric circuit comprising passive components.

16. The antenna of claim 1, wherein placement of the feed point on the feed element controls impedance behavior of the antenna at a plurality of operating frequencies of the device.

17. The antenna of claim 1, wherein the differential mode and the common mode have different impedance characteristics.

18. The antenna of claim 1, wherein the differential mode exhibits a substantially asymmetrical electrical charge distribution, and the differential mode exhibits a substantially antisymmetrical charge distribution.

19. The antenna of claim 2, wherein the non-conductive actuator element is accessible externally of the handheld device.

20. The antenna of claim 11, wherein the button actuator is accessible externally of the handheld radio device.

21. The antenna configuration for the handheld device of claim 1, wherein the substantially planar electrically conductive mass comprises a ground plane of a shield of the handheld device.

22. The antenna configuration for the handheld device of claim 1, wherein the substantially planar electrically conductive mass comprises a ground plane of a battery of the handheld device.

23. The handheld radio device of claim 9, wherein the substantially planar electrically conductive mass comprises a ground plane of a shield of the handheld radio device.

24. The handheld radio device of claim 9, wherein the substantially planar electrically conductive mass comprises a ground plane of a battery used to power the handheld radio device.

25. An antenna configuration for a handheld device, comprising:

an uninterrupted bezel forming an outer perimeter electrically conductive member of the handheld device;

a substantially planar electrically conductive mass disposed within the handheld device forming a contiguous slot between the planar electrically conductive mass and the uninterrupted bezel, wherein the uninterrupted bezel surrounds the planar electrically conductive mass disposed within the same plane as the uninterrupted bezel;

a bezel slot formed in the uninterrupted bezel;

a notch realized on the substantially planar electrically conductive mass;

a first feed element disposed within the contiguous slot of the uninterrupted bezel;

a second feed element disposed in the bezel slot;

wherein at least one of the first and second feed elements is selectively switchable; and a loading impedance providing shunt loading of the bezel slot, wherein the shunt loading of the bezel slot controls matching of the bezel to a predetermined radio frequency band.

* * * * *